US005342509A

United States Patent [19]

Snider et al.

[11] Patent Number: 5,342,509

[45] Date of Patent: Aug. 30, 1994

[54] FOULING REDUCING DUAL PRESSURE FRACTIONAL DISTILLATOR

[75] Inventors: Sheri R. Snider; David A. Bamford; Rimas V. Vebeliunas; Roy T. Halle; Robert D. Strack, all of Houston, Tex.

[73] Assignee: Exxon Chemical Patents Inc., Linden, N.J.

[21] Appl. No.: 950,622

[22] Filed: Sep. 24, 1992

[51] Int. Cl.[5] ..... C10G 7/02

[52] U.S. Cl. ..... 208/351; 208/48 R; 203/80

[58] Field of Search ..... 208/351, 48 R; 203/80

[56] References Cited

U.S. PATENT DOCUMENTS

| | | | |
|---|---|---|---|
| 3,783,126 | 1/1974 | Hayward et al. . | |
| 4,002,554 | 1/1977 | Borge et al. . | |
| 4,525,244 | 6/1985 | Gourlia et al. | 203/26 |
| 4,545,855 | 10/1985 | Sweeney . | |
| 4,545,895 | 10/1985 | Brand et al. | 208/351 |
| 4,670,131 | 6/1987 | Ferrell . | |
| 4,824,527 | 4/1989 | Erickson . | |
| 5,090,977 | 2/1992 | Strack et al. | 62/23 |

FOREIGN PATENT DOCUMENTS

0054367A3 6/1982 European Pat. Off. .

OTHER PUBLICATIONS

Timothy A. Morrison and Diane Laflamme, "Advanced Controls Improve Performance of Two-Shell, Dual-Pressure Column", Oil & Gas Journal, May 14, 1990, pp. 60–63.

*Primary Examiner*—Johann Richter
*Assistant Examiner*—Michael B. Hydorn
*Attorney, Agent, or Firm*—Linda K. Russell

[57] ABSTRACT

A process flow sequence for the reduction of polymer fouling while maintaining efficient production levels wherein a dual pressure, dual column configuration is used to effect the reduction in polymer fouling. The dual pressure, dual column configuration of the invention uses a high pressure and a separate low pressure to isolate the desired fractions while effecting a reduction in the production of fouling polymers.

11 Claims, 1 Drawing Sheet

FOULING REDUCING DUAL PRESSURE FRACTIONAL DISTILLATOR

BACKGROUND OF THE INVENTION

1. Field of the Invention

This invention relates to a method for the reduction of polymer fouling in the fractional distillation of light end hydrocarbon components such as those produced by steam cracking. More particularly, the invention relates to a method of reducing fouling by use of a dual pressure, dual column fractionation configuration instead of a conventional single pressure, single column configuration.

2. Description of the Prior Art

Reaction conditions for steam cracking are selected to maximize the production of light olefins. Typically, cracking is practiced at a weight ratio of 0.3:1.0 of steam to hydrocarbon with the reactor coil outlet at 760°–870° C., and slightly above 100 kPa (atmospheric) pressure.

The type of feedstocks and the reaction conditions determine the mix of products produced. Many steam crackers operate on light paraffin feeds consisting of ethane and propane and the like. However, a significant amount of steam cracking capacity operates on feedstocks which contain propane and heavier compounds. Steam cracking such feedstocks produces many marketable products, notably propylene, isobutylene, butadiene, amylene and pyrolytic gasoline.

In addition to the foregoing, small quantities of undesirable contaminants, such as di- and polyolefins, and acetylinic compounds are produced. These contaminants may cause equipment fouling, interfere with polymerization reactions, and in some cases pose safety hazards. It is, therefore, highly desirable to remove them from the distillation stream. It is in the removable form the distillation stream of these contaminants that this invention has its application.

During steam cracking, cracked gases emerging from the reactors are rapidly quenched to arrest undesirable secondary reactions which tend to destroy light olefins. The cooled gases are subsequently compressed and separated to recover the various olefins.

The recovery of the various olefin products is usually carried out by fractional distillation using a series of distillation steps or columns to separate out the various components. The unit which separates the methane fraction ($C_1$) is referred to as the "demethanizer," the unit which separates the ethane fraction ($C_2$) is referred to as the "deethanizer," the unit which separates the propane fraction ($C_3$) is referred to as the "depropanizer," and the unit which separates the butane fraction ($C_4$) is referred to as the "debutanizer." The residual higher carbon number fraction ($C_{5+}$) is used as gasoline.

With the development of selective furnace designs for very high conversion of liquid petroleum gas by steam cracking the amount of $C_5$ products has been minimized, although at a correspondingly higher concentration of lower carbon atom number foulant precursors such as di-olefinic, poly-olefinic and acetylinic compounds. This development has served to exacerbate the fouling problem which has heretofore been encountered in the fractional distillation of $C_2$, $C_3$ and $C_4$ fractions from each other and from heavier hydrocarbons. Fouling of the debutanizer unit by reason of the aforementioned increase in the concentration of foulant precursors has become a particular problem of increased concern.

A considerable amount of work has been done on improving the basic process of separating the products of steam cracking. Much of the work on light ends fractionation has been concerned with the improvement of the various components of the process. Other improvements relate to improved computer control of the process. Progress has also been made in the optimum design and operation of the process through the use of improved physical property correlations. Although there have been improvements in the sophistication of the design of fractionation steps such as two-tower demethanizers, deethanizers, and depropanizers, heat-pumped towers, and improved separation efficiencies through the use of dephlegmators, the basic flow sequences have remained essentially unchanged.

One of the basic problems encountered in such fractional distillation processes relates to polymer fouling of the fractional distillation columns. One such problem, for example, relates to the production of foulant precursors in steam cracking which at high temperatures cause fouling in equipment. It is well known that the rate of polymer fouling increases as temperature increases. Such fouling often necessitates the shutdown of the distillation unit for cleaning. Both the shutdown and cleaning involve significant expense.

While changes in the operating conditions, as in for example reducing the operating temperature and/or pressure, have been used to control these fouling problems, such changes are many times not sufficient to overcome the problem completely. In addition, operating modifications can result in reduced production efficiency which translates to an associated decrease in revenues.

U.S. Pat. No. 4,545,895 to Brand et. al. teaches yet another alternative approach to reduce fouling. This process relates to the reduction of fouling by controlling reboiler temperatures.

U.S. patent No. 3,783,126 to Hayward et. al. teaches a dual pressure fractionation tower with a high pressure and a low pressure section. The process of the invention requires delivery of the overhead vapors from the low-pressure column to the high pressure column. The invention is particularly suitable for use as a depropanizer.

U.S. Pat. No. 4,824,527 to Erickson teaches a method of fractionating liquid mixtures of unequal amounts of heavy and light product fractions wherein two columns are used. In the case of a feed mixture having a majority of light product the heavy feed from a rectifier column is delivered into the second column.

U.S. Pat. No. 4,002,554 to Borge et. al. teaches an approach to minimize fouling in the internal surface of a metallic heating unit involving the purging of the heating unit with an inert gas followed by introduction of nitric oxide into said heating unit. The heating unit is subsequently purged with an inert gas whereupon the heating unit is ready for introduction of a hydrocarbon feedstock.

U.S. Pat. No. 4,670,131 to Ferrell teaches an alternative approach to minimize fouling. This process relates to inhibition of polymerization of olefinic compounds which results in fouling by introduction of stable free radicals, such as nitroxide, into the system.

A need still exists for a method of reducing fouling which does not require the addition of extraneous chemicals which could affect quality of the final product, since these extraneous chemicals are expensive and do not fully control fouling.

SUMMARY OF THE INVENTION

This invention successfully addresses the need for a method for reducing fouling in fractionating columns.

The instant invention relates to the use of a dual pressure, dual column fractionator configuration rather than a conventional single pressure, single column fractionator configuration. The dual pressure, dual column fractionator configuration of the instant invention results in a marked reduction in fouling.

The dual pressure, dual column fractionator configuration of the present invention includes a high pressure column component and a low pressure column component. A feedstock is delivered into the high pressure column wherein the feedstock is fractionated into heavy components and light components.

The heavy components of the high pressure column are fed into a low pressure column wherein the heavy components are fractionated into a tops stream and bottoms stream.

The tops stream of the low pressure column is combined with the light components from the high pressure column.

The dual pressure, dual column fractionator configuration of the present invention may be customized for operation as a debutanizer, a deethanizer or a depropanizer.

BRIEF DESCRIPTION OF THE DRAWINGS

The above and other embodiments of the present invention may be more fully understood from the following detailed description, when taken together with the accompanying drawing, in which.

DESCRIPTION OF THE PREFERRED EMBODIMENTS

Figure 1:
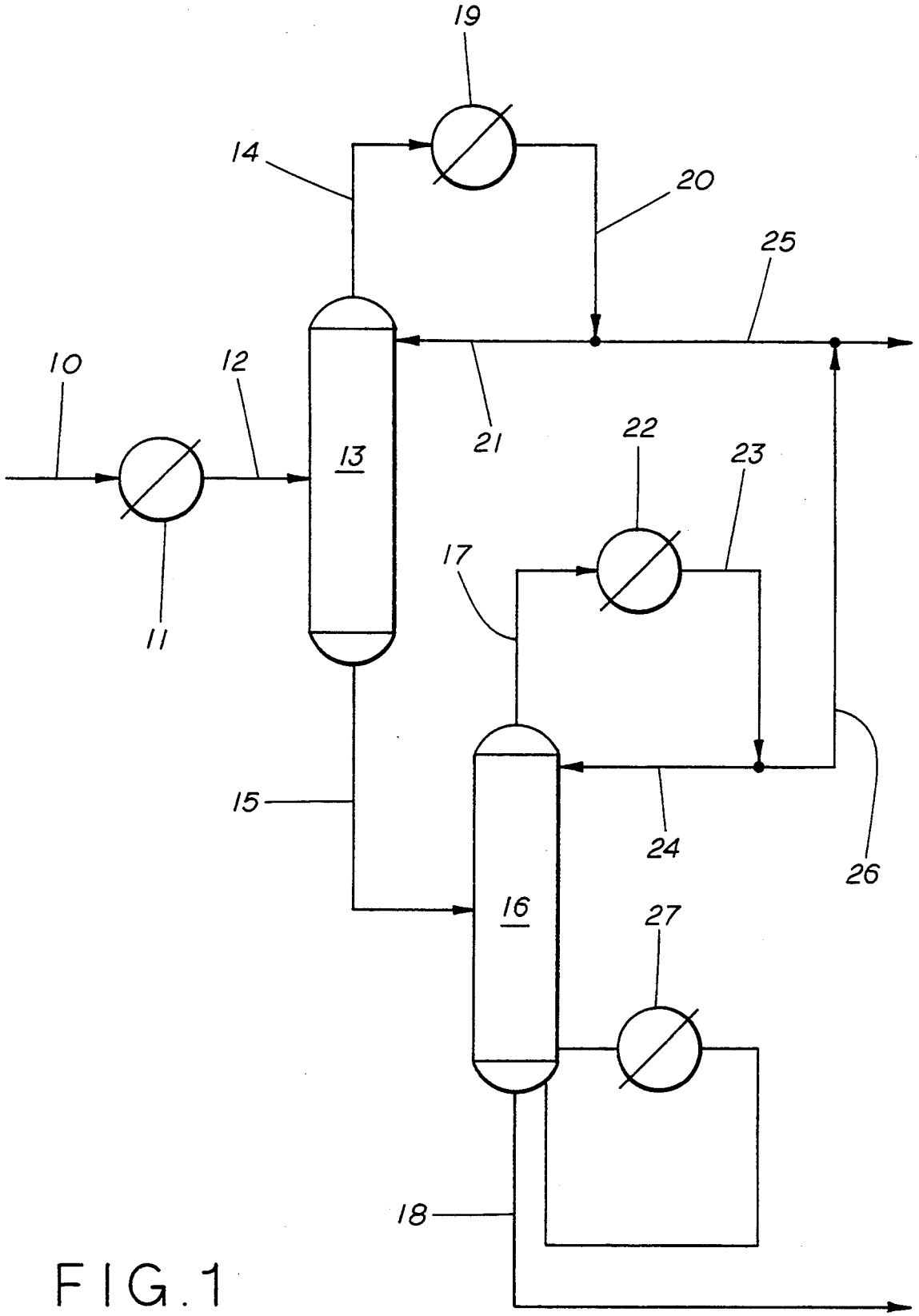
FIG. 1 is a flow diagram of a dual pressure, dual column debutanizer.

The present invention of a method for the reduction of fouling in the treatment of cracked hydrocarbon gases involves the use of a dual pressure, dual column fractionator configuration rather than the conventional single pressure, single column fractionator configurations.

While the dual pressure, dual column fractionator configuration of the present invention is suitable for a variety of fractionating column systems, FIG. 1 and the subsequent discussion describes, without in any way limiting the scope of the present invention one particular embodiment of the present invention, namely a dual pressure, dual column debutanizer. The feedstock 10 may a mixture of cracked hydrocarbons, generally feedstock 10 will be the bottoms stream ($C_4$ and $C_{5+}$) fraction from a deethanizer or a depropanizer, although alternative feed compositions and sequences are possible. Feedstock 10 is fed into a preheater 11 wherein the feedstock is partially or totally vaporized. Preheater 11 which serves to vaporize all or part of the feedstock is operated at temperatures ranging from about 10 to about 200, preferably from about 50° to about 90° C. The preheated feedstock 12 is fed to a high pressure fractional distillation column 13 wherein preheated feedstock 12 is divided into a light fraction 14 and a heavy fraction 15. Preheated feedstock 12 entering the high pressure fractional distillation column is at a pressure ranging from about 3 to about 20, preferably about 7 Bar G. Bar G represents bars at gauge or a measure of pressure where the gauge will read 0 at a pressure of 1 atmosphere. Vaporized feedstock 12 is preferably introduced to the high pressure fractional distillation column at or near the bottom tray of the high pressure fractional distillation column 13. Light fraction 14 typically includes a $C_4$ fraction which contains from about 30 to about 100, preferably greater than 50 weight percent, most preferably about 85 weight percent of all the foulant precursors contained in vaporized feedstock 12. Light fraction 14 represents from about 10 to about 99, preferably about 80 weight percent of preheated feedstock 12. Heavy fraction 15 includes the bulk of the $C_{5+}$hydrocarbons.

Heavy fraction 15 is fed to a low pressure fractional distillation column 16, wherein the heavy fraction 15 is divided into a tops stream 17 and a bottoms stream 18. Low pressure fractional distillation column 16 includes a reboiler loop Tops stream 17 includes any remaining $C_4$hydrocarbons while bottoms stream 12 includes the $C_{5+}$hydrocarbon fraction which may be used for gasoline. Light fraction 14 is condensed in a condenser 19 to form a condensed stream 20. A reflux stream 21 is recirculated into high pressure column Tops stream 17 is condensed in a low pressure condenser 22 to form a condensed stream 23. A reflux stream 24 is recirculated into low pressure column 16. The balance of condensed stream indicated as 25, is combined with balance of condensed stream 23, indicated as 26. Bottoms stream 18 from the low pressure fractional distillation column 16 includes the $C_{5+}$fraction which may be used as gasoline.

Fouling is reduced in the high pressure column 13 in spite of the high concentration of foulant precursors present in the feedstock 12, due to the low temperature at which the column is operated, which temperature ranges from about −50 to about 200, preferably from about −10° to about 110 ° C. The high pressure column 13 is operated at pressures ranging from about 2 to about 20, preferably about 6 Bar G. The high pressure column is not operated in a stripping mode which obviates the need for a reboiler loop. The source of heat for operation of the column is restricted to heat generated by the preheater which vaporizes the feed.

Fouling is reduced in low pressure column 16 because it is also operated at temperatures below those required in a conventional single pressure, single column configuration. The temperatures for operation of the low pressure column 16 range from about −50 to about 200, preferably from about 14° to about 65° C. Although the low pressure column operates in a stripping mode with a reboiler loop, the fact that it operates at lower temperatures taken together with both the reduced content of $C_4$contaminants in the feed 15, and the overall reduction of feed volume entering the column serve to reduce the level of fouling in this column. Low pressure column 16 is operated at pressures ranging from about 0 to about 7, preferably about 2 Bar G. Operation of the dual pressure fractional distillator of the present invention additionally results in an overall energy savings.

From this description of preferred embodiments of the invention, those skilled in the art may find variations and adaptations thereof, and all such variations and adaptations, falling within the scope and spirit of this invention, are intended to be covered by the claims which follow.

We claim:

1. A method for the fractionation of a mixture of cracked hydrocarbons produced by a cracking unit containing foulant precursors which reduces polymer fouling, comprises the steps of:

(a) partially vaporizing said mixture in a preheater operating at 7 to 20 Bar G;

(b) separating said mixture of cracked hydrocarbons which is at least partially vaporized in a high pressure fractional distillation column operating at 6 to 20 Bar G wherein said mixture is separated into high pressure fractional distillation light components (b1) and high pressure fractional distillation heavy components (b2) diminished in foulant precursors without further heating of the high pressure heavy components (b2);

(c) separating said high pressure factional distillation heavy components (b2) in a low pressure fractional distillation column operating at about 2 Bar G into a low pressure fractional distillation tops stream (c1) and a low pressure fractional distillation bottoms stream (c2) with a diminished quantity of foulant precursors; and (d) combining said high pressure fractional distillation light components (b1) with the low pressure fractional distillation tops stream (c1) to produce a light fraction containing the increased amount of foulant precursors.

2. The method of claim 1, wherein the high pressure fractional distillation column is operated at a temperature range of −50° to 200° C.

3. The method of claim 1, wherein the light components comprise about 80 weight percent of said mixture.

4. The method of claim 3, wherein the light components comprise about 85 weight percent of foulant precursors.

5. The method of claim 1, wherein said low pressure fractional distillation column is operated at a temperature range of −50° to 200 ° C.

6. A process to reduce polymer fouling in a debutanizer comprising the steps of:

(a) feeding a cracked hydrocarbon mixture comprising $C_4$ and $C_{5+}$ hydrocarbons into a preheater operating at 7 to 20 Bar G wherein said mixture is at least partially vaporized;

(b) separating the so vaporized mixture in a high pressure fractional distillation column operating at 6 to 20 Bar G into a high pressure fractional distillation $C_4$ light component enriched in foulant precursors (b1) and a high pressure fractional distillation $C_4$ and $C_{5+}$ heavy component (b2) diminished in foulant precursors without further heating of the heavy components (b2);

(c) separating the $C_4$ and $C_{5+}$ heavy component (b2) in a low pressure fractional distillation column operating at about 2 Bar G into a low pressure fractional distillation $C_4$ tops stream (c1) and a low pressure distillation $C_{5+}$ bottoms stream (c2) containing a lower proportion of foulant precursors than said mixture; and (d) combining said high pressure fractional distillation $C_4$ light component (b1) with said low pressure fractional distillation $C_4$ tops stream (c1) to produce a light fraction containing the increased amount of foulant precursors.

7. The process of claim 6, wherein said mixture comprises $C_3$, $C_4$ and $C_{5+}$ hydrocarbons.

8. The process of claim 6, wherein the high pressure fractional distillation column is operated at a temperature range of −50° to 200° C.

9. The process of claim 6, wherein the $C_4$ light component comprises about 80 weight percent of the feedstock.

10. The process of claim 9, wherein the $C_4$ light component comprises greater than 50 weight percent of foulant precursors.

11. The process of claim 6, wherein the low pressure fractional distillation column is operated at a temperature range of −50° to 200° C.

* * * * *